US005896667A

United States Patent [19]

Hawkins

[11] Patent Number: 5,896,667

[45] Date of Patent: Apr. 27, 1999

[54] PLASTIC WRAP PIERCING-CUTTING DEVICE

[76] Inventor: Jennifer B. Hawkins, 33 Colleen Ct., Kendall Park, N.J. 08824

[21] Appl. No.: 08/878,304

[22] Filed: Jun. 18, 1997

[51] Int. Cl.[6] ..... B26B 1/00; B26B 3/00

[52] U.S. Cl. ..... 30/294; 30/2; 30/DIG. 3

[58] Field of Search ..... 30/129, 138, 139, 30/294, DIG. 3, 2

[56] References Cited

U.S. PATENT DOCUMENTS

| | | | |
|---|---|---|---|
| 1,090,416 | 3/1914 | Roth | 30/159 |
| 1,498,753 | 6/1924 | Rendlich . | |
| 2,215,216 | 9/1940 | Gits et al. | 30/125 X |
| 2,610,399 | 9/1952 | Adams et al. . | |
| 2,764,814 | 10/1956 | Jecker | 30/294 |
| 3,028,670 | 4/1962 | Tilly . | |
| 3,972,117 | 8/1976 | Fogg . | |
| 3,975,822 | 8/1976 | Mobus . | |
| 5,122,152 | 6/1992 | Mull . | |
| 5,297,340 | 3/1994 | Kahicke . | |

*Primary Examiner*—Douglas D. Watts
*Attorney, Agent, or Firm*—Kenneth P. Glynn, Esq.

[57] ABSTRACT

A piercing-cutting device for plastic wrap removed from an object, which includes a handle, a complex blade connected to the handle, the complex blade having a piercing blade section and a cutting blade section, the piercing blade section and the cutting blade section being at substantially right angles to one another, and the cutting blade section being a concave, crescent cutting blade. In some present embodiments, the piercing blade section and the cutting blade section are located contiguously and establish a generally L-shaped or T-shaped relationship relative to one another. In other embodiments the handle is elongated with an imaginary centerline and the complex blade is connected to the handle so as to extend outwardly therefrom at a substantially right angle from the imaginary center line. In yet other present embodiments, the piercing-cutting device of the handle has a front and the complex blade extends outwardly from the front of the handle.

20 Claims, 4 Drawing Sheets

PLASTIC WRAP PIERCING-CUTTING DEVICE

BACKGROUND OF THE INVENTION

1. Field of the Invention

The present invention involves a device for piercing and cutting wrap and other piercable, cuttable materials. More specifically, it involves a unique device with a complex cutting blade which performs rapid, efficient piercing and cutting in a single flow motion.

2. Information Disclosure Statement

U.S. Pat. No. 1,498,753 to Daniel I. Rendlich discloses a carcass opening device having a steel blade with a sharp point on one end and at the other end a flat shank with a flat handle secured on it. Near the handle, there is a branch blade spaced from the main blade with a bead-like element at its end point. A U-shaped curve with continuous sharp edges is formed between the main blade and its branch.

U.S. Pat. No. 2,610,399 to Adams et al. describes and illustrates a ripper for seams having a protected recessed cutting edge with a relatively thin tooth-like probe extending therefrom for insertion between the members to be ripped.

U.S. Pat. No. 2,764,814 to Gustav Jecker discloses a ripping tool having a substantially flat metal shank with two prongs at it ends forming a fork. One of the prongs is elongated and has a pointed end while the other prong is relatively short and has a round enlargement. There are depressions between the prongs which leave a thin countersunk web being inwardly curved and forming a cutting blade.

U.S. Pat. No. 3,028,670 to J. O. Tilly teaches a slitting device having a body portion of generally flat plate-like construction. The body is provided with a slot extending close to one edge and parallel thereto, and in the base of which a removable cutting blade is provided. The blade has a generally hook-shaped cutting edge to prevent jamming of paper or other cut material at an edge of the slot and the blade is further permanently secured to a blade holder removable from the body.

U.S. Pat. No. 3,972,117 to Walter Fogg describes and illustrates a disposable blade device having at one end a pair of spaced blunt unsharpened projections joined by a concave sharpened area and having at its opposite end a blunt point and a narrow stitch picker with a concave edge portion between them.

U.S. Pat. No. 3,975,822 to Richard Mobus discloses a needlepoint and crewel-embroidery stitch remover having a handle secured to a member. The member terminates in a bifurcation with a long tine and a short tine with a cutting surface in the crotch between the tines.

U.S. Pat. No. 5,122,152 to John Mull discloses a suture removing device having a body with a handle portion, a head portion and a cutting edge provided in the handle portion. The head portion has a leading end with a forked tip and a surface extending rearwardly of the tip to the cutting edge.

U.S. Pat. No. 5,297,340 to Hartwig Kahlcke describes and illustrates a parting tool which has and arc shaped blade located between two tines of unequal length to effect a cut. The long tine may have a thorn-like point and the short tine may have a spherical thickening above the blade. The tines pass over into a shaft which is fastened to one end of a shaft holder.

Thus, while various opening and cutting devices have been developed, none teach the complex blade structure having a blade section and a cutting section at substantially right angles to each other of the present invention. Notwithstanding the prior art, the present invention is neither taught nor rendered obvious thereby.

SUMMARY OF THE INVENTION

A piercing-cutting device for plastic wrap removed from an object, which includes a handle, a complex blade connected to the handle, the complex blade having a piercing blade section and a cutting blade section, the piercing blade section and the cutting blade section being at substantially right angles to one another, and the cutting blade section being a concave, crescent cutting blade. In some present embodiments, the piercing blade section and the cutting blade section are located contiguously and establish a generally L-shaped or T-shaped relationship relative to one another, when taken from a frontal view at right angles to the extended length of the complex blade. In other embodiments the handle is elongated with an imaginary centerline and the complex blade is connected to the handle so as to extend outwardly therefrom at a substantially right angle from the imaginary center line. In yet other present embodiments, the piercing-cutting device of the handle has a front and the complex blade extends outwardly from the front of the handle.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
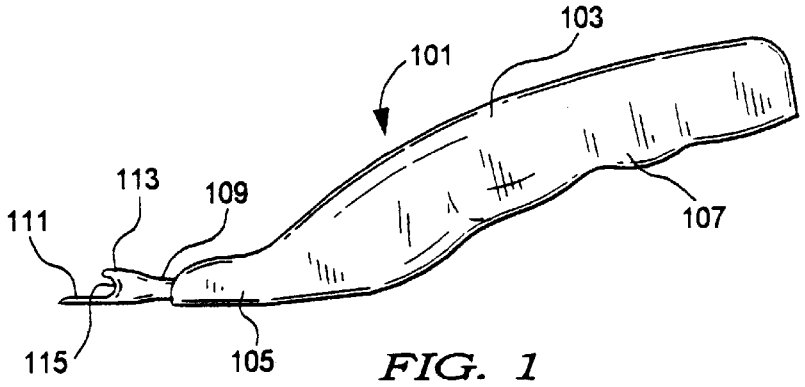
FIG. 1 illustrates a side view of one embodiment of a present invention piercing-cutting device and FIG. 2 illustrates a top view thereof.
Figure 2:
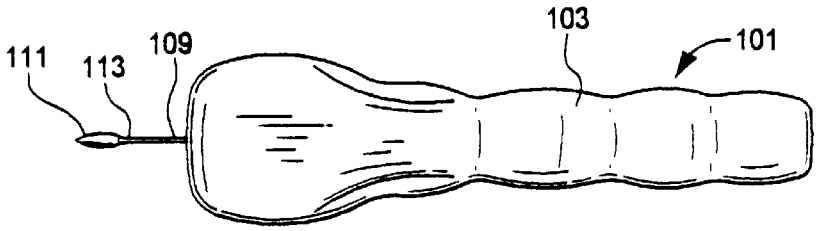

FIG. 1 shows a side view of the present invention piercing-cutting device 101 and FIG. 2 shows a top view thereof. Device 101 includes handle 103 which has a base 105 and an ergonomically designed holding portion 107 with a complex blade 109. Complex blade 109 has an extended piercing blade section 111 and a cutting blade section 113 with a sharpened portion 115. It is important to note that the cutting blade section 113 of the complex blade 109 used in the present invention has a concave shape to capture the material being cut so as to prevent it from slipping off the blade.

The present invention device 101 is hand held by a user basically as shown in FIG. 1 with base 105 in the horizontal position. A plastic wrapped package such as a compact disc, a music tape, a video movie or the like, is placed on a flat surface and held, or is hand held with one hand and device 101 is held with the other hand, tipped upwardly slightly at the handle end and pushed forward so that piercing blade section 111 pierces the plastic. Next, base 105 is rested on the surface of the package and pushed forward so that cutting blade section 113 cuts through the plastic. This permits certain and fast opening of plastic wrapped packages with minimal or no damage to the package or article.

Figure 3:
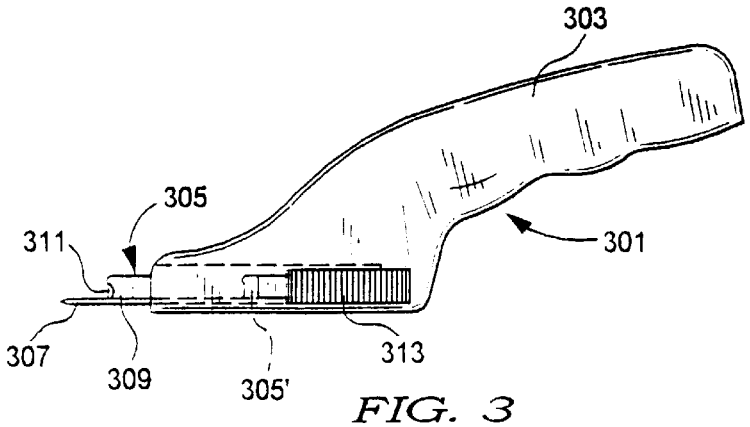
FIGS. 3 and 4 show a side view and a top view of an alternative present invention piercing-cutting device wherein the blade extends outwardly from the front of the handle in a retractable fashion.
Figure 4:
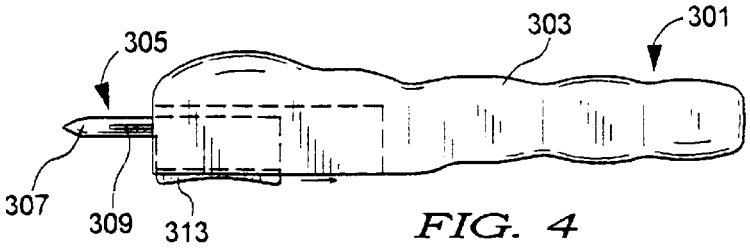

FIGS. 3 and 4 show a side view and a top view of an alternative present invention piercing-cutting device wherein the blade extends outwardly from the front of the handle in a retractable fashion. FIG. 3 shows present invention piercing-cutting device 301 with handle 303 and complex blade 305. Retracting thumb lever 313 is shown in the closed position (retracted) with complex blade 305' nested within a hollow area within handle 303. FIG. 3 also shows blade 305 extracted illustrating piercing blade section 307 and cutting blade section 309 with sharpened edge 311. Retracting thumb lever 313 is not shown in FIG. 3 in its open position, but is shown in that position in side view FIG. 4 where identical parts are identically numbered.

Figure 5:
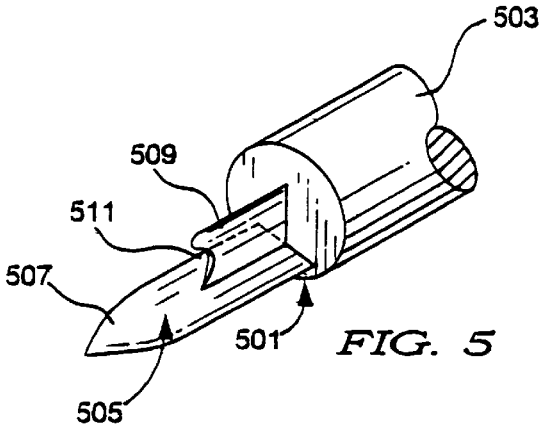
FIGS. 5, 8 and 11 show oblique front views of three different alternative blade embodiments for the present invention piercing-cutting device.
Figure 6:
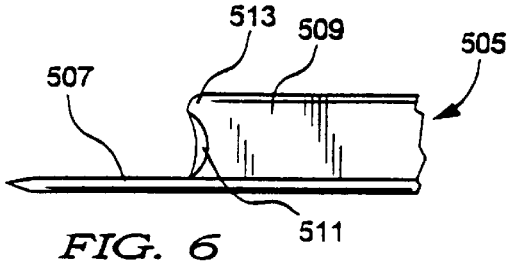
FIGS. 6, 9 and 12 show side views of each is of these respectively.
Figure 7:
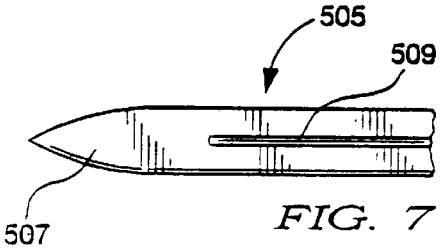
FIGS. 7, 10 and 13 show top views thereof.

Referring now to FIG. 5, there is shown an oblique front partial view of the present invention piercing-cutting device 501 with handle 503 (partial) and complex blade 505. FIGS. 6 and 7 show side and top views of device 501's complex blade 505. All three of these figures are discussed collectively. Complex blade 505 is connected to handle 503, such as by embedding in plastic for a plastic handle, gluing, screwing, force fitting or any other means within the skill of the artisan for attaching blades to handles. Complex blade 505 includes a piercing blade section 507 and a cutting blade section 509 with sharp edge 511 as can be seen from these figures, piercing blade section 507 extends beyond the end of cutting blade section 509 and is at right angles thereto forming a "T" shape arrangement. Note that for safety, cutting blade section 509 has a blunt nose 513 to inhibit accidental cutting by a user. Likewise, because the cutting blade section 509 is located inwardly relative to piercing blade section 507, the sharpened edge is less likely to cause injury to the user. This is further enhanced by the concavity of cutting blade section 509.

Figure 8:
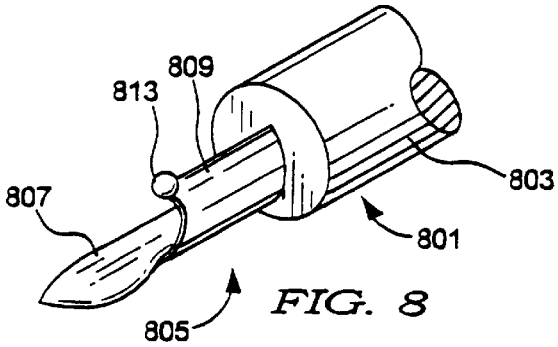
Figure 9:
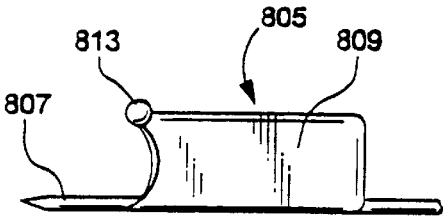
Figure 10:
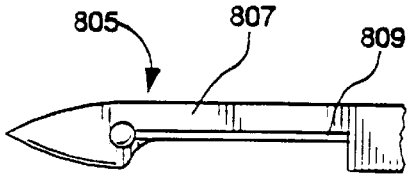

FIGS. 8, 9 and 10 show front oblique view, side blade view and top blade view, respectively, of an alternative present invention piercing-cutting device 801. A partial view of handle 803 is shown in FIG. 8 along with blade 805. Blade 805 includes a piercing blade section 807 and cutting blade section 809. In this embodiment flat stock is utilized and cutting blade 809 is partially cut from piercing blade 807 and shaped at a right angle thereto, as shown. Plastic safety bead 813 is then added for safety. Alternatively, a blunt top may be formed as part of the cutting blade section 809 to act in a fashion similar to the plastic safety bead. As can be seen, piercing blade section 807 and cutting blade section 809 form an "L" shape.

Figure 11:
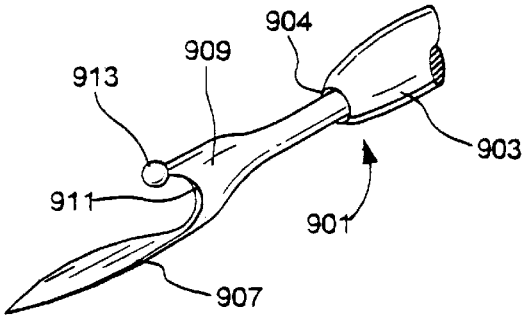
Figure 12:
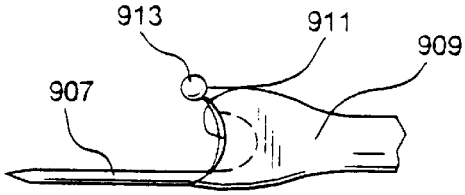
Figure 13:
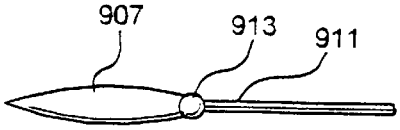

FIGS. 11, 12 and 13 show the same views as above, but of alternative embodiment piercing-cutting device 901. Device 901 includes handle 903 and complex blade 904. Complex blade 904 includes piercing blade section 907, cutting blade section 909, with sharpened portion 911 and safety bead 913.

Figure 14:
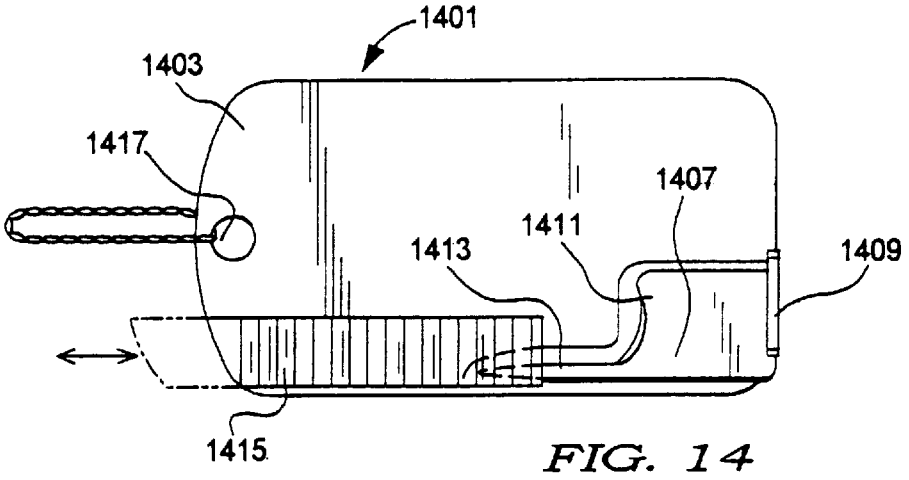
FIG. 14 shows a side view of an alternative blade embodiment of the present invention piercing-cutting device wherein the blade is hingedly connected to the handle to swing in for storage, in a door hinge fashion, and includes a hole for a key chain.
Figure 15:
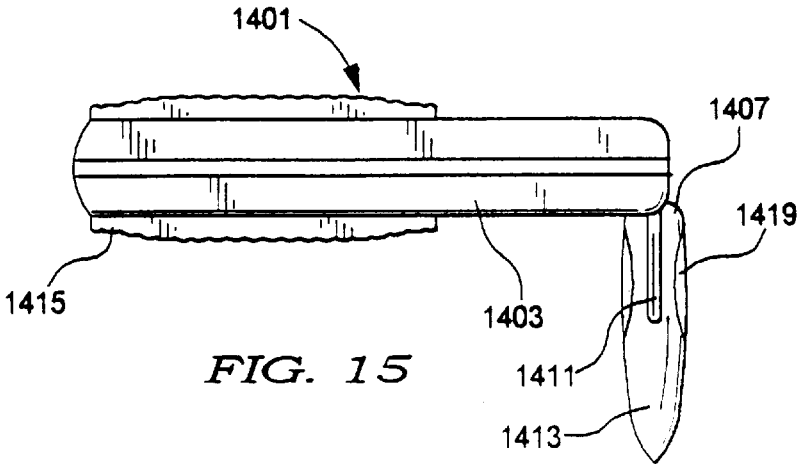
FIG. 15 shows a top view thereof.

FIG. 14 shows a side view of an alternative blade embodiment of the present invention piercing-cutting device wherein the blade is hingedly connected to the handle to swing in for storage, in a door hinge fashion, and includes a hole for a key chain, and FIG. 15 shows a top view thereof. Referring to the present invention piercing-cutting device 1401 shown in both figures there is shown a flat "credit card" handle 1403. Attached thereto is hinge 1409 with complex blade 1407 so that blade 1407 may be swung out 90° at hinge 1409. Complex blade 1407 includes a leading piercing blade section 1413 and a cutting blade section 1411. Slide safety catch 1415 is included and this may be slid inwardly and outwardly, as shown, to contain complex blade 1407 in its closed position or to permit opening of complex blade 1407 to its cutting position. As shown in FIG. 15, complex blade 1407 contains thumbnail grooves such as groove 1419 to permit easy opening. Once in the open position as shown in FIG. 15, a user may use the device by holding handle 1403 and piercing and cutting plastic wrap. Orifice 1417 may be used to insert a key chain or key ring, as the user may desire. Additionally, the height may be reduced to render it more compact, for example, by eliminating handle 1403's top third.

Figure 16:
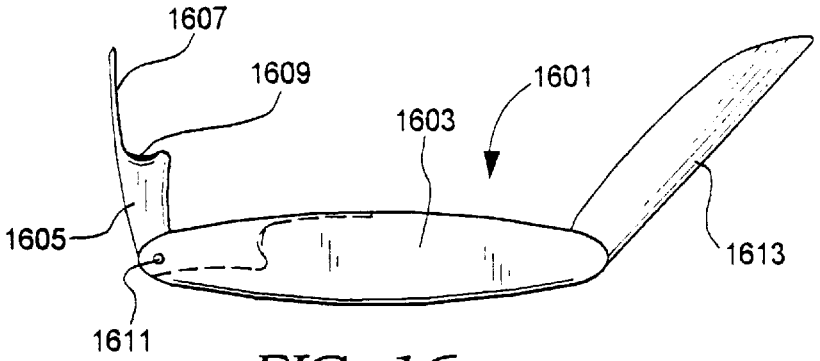
FIG. 16 shows another alternative blade embodiment of the present invention piercing-cutting device with a blade which folds in a jackknife fashion.

FIG. 16 shows a side view of a jackknife-type present invention device 1601 with handle 1603, complex blade 1605 with piercing blade portion 1607 and cutting blade section 1609. Device 1601 also includes conventional jackknife blade 1613. Complex blade 1605 is pivotally hinged on with hinge pin 1611 and may be spring biased as are other jackknife blades and components so as to spring lock into an open or closed position. Likewise, hinge 1409 and complex blade 1407 in FIGS. 14 and 15 could similarly be spring biased.

Figure 17:
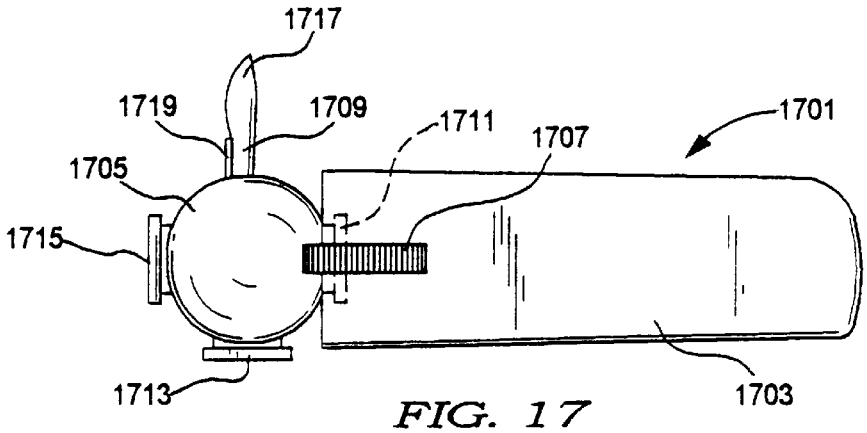
FIGS. 17, 18 and 19 show a present invention piercing-cutting device with an alternative blade embodiment which has a removable blade holder to permit use of the device with alternative blade positions, including right angle right handed, in-line and right angle left handed arrangements; and, FIG. 20 shows a side view of a present invention combination exacto or straight or razor blade knife piercing-cutting device.
Figure 18:
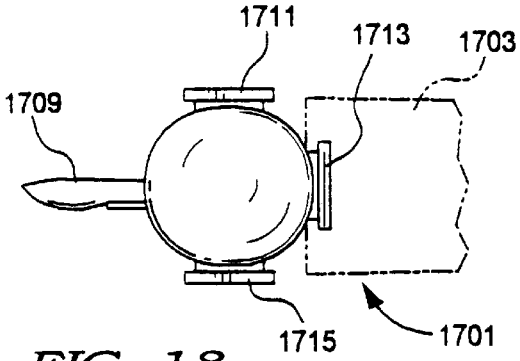
Figure 19:
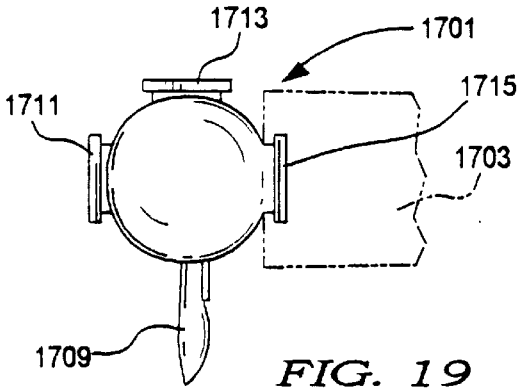

FIGS. 17, 18 and 19 show a present invention piercing-cutting device 1701 with an alternative blade embodiment which has a removable blade holder to permit use of the device 1701 with alternative blade positions, including right angle right handed, in-line and right angle left handed arrangements. FIG. 17 shows blade attachment member 1705 connected to handle 1703 with complex blade 1709 positioned for right angle right handed use. Blade attachment member 1705 is removable by latch 1707 and may be taken out and rotated to reposition blade 1709. Thus, blade attachment member 1705 has socket insert 1711, 1713 and 1715, as shown. Complex blade 1709 has piercing blade section 1717 and cutting blade section 1719, as shown.

FIG. 18 has socket insert 1713 inserted into handle 1703 so that complex blade 1709 is in straight alignment with handle 1703 and FIG. 19 has socket insert 1715 inserted into handel 1703 for right angle left handed use.

Figure 20:
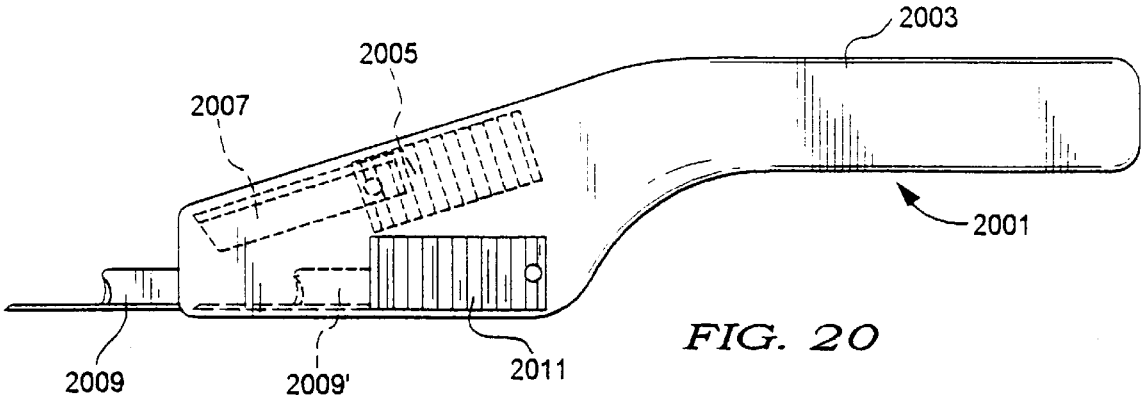

FIG. 20 shows present invention device 2001 which operates both as a piercing-cutting device and an exacto or razor blade type knife. Handle 2003 accommodates a razor type cutting blade 2007 with ejector blade 2005 and complex piercing-cutting blade 2009 (shown inserted as 2009'), which is connected to ejector button 2011. Razor type cutting blade 2007 and ejector blade 2005 are on the opposite side from complex piercing-cutting blade 2009 and ejector button 2011. Ejector blade 2005 can have internal position relative to ejector button 2011 so that either razor type cutting blade 2007 or complex piercing-cutting blade 2009 can be in the open position, but not both at the same time. For example, ejector blade 2005, in the open position, could block the movement of present invention complex piercing cutting blade 2009 and vice versa. More specifically, the aforesaid ejector buttons could have internal aspects positioned such that only one of them could be moved to the open position at any given time. Thus, device 2001 may be used for piercing and cutting plastic wrap with complex blade 2009 and may be used to slit cardboard packaging and twined packaging and other types of wrappings with straight blade 2007.

Obviously, numerous modifications and variations of the present invention are possible in light of the above teachings. It is therefore understood that within the scope of the appended claims, the invention may be practiced otherwise than as specifically described herein.

What is claimed is:

1. A piercing-cutting device for plastic wrap removed from an object, which comprises:

(a) a handle;

(b) a complex blade connected to said handle, said complex blade having a flat piercing blade section and a flat cutting blade section, said flat piercing blade section and said flat cutting blade section being at substantially right angles to one another, and said flat cutting blade section having a concave, crescent cutting blade, wherein said flat piercing blade section and said flat cutting blade section are located contiguously and established a generally L-shaped relationship relative to one another.

2. The piercing-cutting device of claim 1 wherein said flat piercing blade section and said flat cutting blade section are integrally, unistructurally formed.

3. The piercing-cutting device of claim 1 wherein said piercing blade section is longer than said cutting blade section and extends outwardly therefrom.

4. The piercing-cutting device of claim 2 wherein said piercing blade section is longer than said cutting blade section and extends outwardly therefrom.

5. The piercing-cutting device of claim 1 wherein said handle has a front and said complex blade extends outwardly from said front of said handle.

6. The piercing-cutting device of claim 1 wherein said device complex blade is a retractable complex blade.

7. The piercing-cutting device of claim 1 wherein said handle is sufficiently hollow to store said blade and said blade is hingedly connected to said handle under tension, such that said handle and complex blade function in a jack knife fashion.

8. The piercing-cutting device of claim 1 wherein said handle is sufficiently hollow to store said blade and said blade is hingedly connected to said handle, such that said handle and complex blade function in a door hinge fashion.

9. A piercing-cutting device for plastic wrap removed from an object, which comprises:

(a) a handle;

(b) a complex blade connected to said handle, said complex blade having a flat piercing blade section and a flat cutting blade section, said flat piercing blade section and said flat cutting blade section being at substantially right angles to one another, and said flat cutting blade section having a concave, crescent cutting blade, wherein said flat piercing blade section and said flat cutting blade section are located contiguously and establish a generally T-shaped relationship relative to one another.

10. The piercing-cutting device of claim 9 wherein said flat piercing blade section and said flat cutting blade section are integrally, unistructurally formed.

11. The piercing-cutting device of claim 9 wherein said piercing blade section is longer than said cutting blade section and extends outwardly therefrom.

12. The piercing-cutting device of claim 10 wherein said piercing blade section is longer than said cutting blade section and extends outwardly therefrom.

13. The piercing-cutting device of claim 9 wherein said handle has a front and said complex blade extends outwardly from said front of said handle.

14. The piercing-cutting device of claim 9 wherein said device complex blade is a retractable complex blade.

15. The piercing-cutting device of claim 9 wherein said handle is sufficiently hollow to store said blade and said blade is hingedly connected to said handle under tension, such that said handle and complex blade function in a jack knife fashion.

16. The piercing-cutting device of claim 9 wherein said handle is sufficiently hollow to store said blade and said blade is hingedly connected to said handle, such that said handle and complex blade function in a door hinge fashion.

17. A piercing-cutting device for plastic wrap removed from an object, which comprises:

(a) a handle;

(b) a complex blade connected to said handle, said complex blade having a flat piercing blade section and a flat cutting blade section, said flat piercing blade section and said flat cutting blade section being at substantially right angles to one another, and said flat cutting blade section having a concave, crescent cutting blade, wherein said flat piercing blade section and said flat cutting blade section are located contiguously to one another; and, (c) a blade holder component for indirect, removable, connection of said complex blade to said handle, and wherein said handle and blade holder component each have complimentary connecting means for removably connecting said blade holder component to said handle.

18. The piercing-cutting device of claim 17 wherein said blade holder component has a plurality of connecting means to enable removal of said blade holder component from said handle and reattachment thereto with a different connecting means to enable a user to have choice of positioning of said blade relative to said handle for optimum use by left-handed user and, alternatively, by a right-handed user.

19. The piercing-cutting device of claim 18 wherein said piercing blade section and said cutting blade section are located contiguously and established a generally L-shaped relationship relative to one another.

20. The piercing-cutting device of claim 18 wherein said piercing blade section and said cutting blade section are located contiguously and establish a generally T-shaped relationship relative to one another, with said cutting blade section establishing the base of the T.

* * * * *